United States Patent [19]

Buhr et al.

[11] 4,090,766

[45] May 23, 1978

[54] TEST CONNECTOR ADAPTOR

[75] Inventors: George A. Buhr; Joseph J. Borowicz; Donald C. McKinnon, all of Cheboygan, Mich.

[73] Assignee: Fox Valley Instrument Company, Cheboygan, Mich.

[21] Appl. No.: 812,499

[22] Filed: Jul. 5, 1977

[51] Int. Cl.[2] ..... H01R 3/00

[52] U.S. Cl. ..... 339/113 L; 324/51; 339/10

[58] Field of Search ..... 339/113 R, 113 B, 113 L, 339/10; 324/51, 73 R

[56] References Cited

U.S. PATENT DOCUMENTS

| | | | |
|---|---|---|---|
| 3,813,632 | 5/1974 | Drewry | 339/10 |
| 3,945,706 | 3/1976 | Steiner et al. | 339/113 L |

*Primary Examiner*—Roy Lake
*Assistant Examiner*—DeWalden W. Jones
*Attorney, Agent, or Firm*—Price, Heneveld, Huizenga & Cooper

[57] ABSTRACT

This specification discloses a connector adaptor for electrical interconnection with a diagnostic connector in an automobile. The connector adaptor permits easy access to and labeling of a diagnostic connector which can include, for example, an aligned row of recessed terminals. The connector adaptor includes a panel supporting a plurality of generally L-shaped conductive strips each having a terminal section and a generally perpendicular leg section. The leg sections are of different lengths so that the terminal sections can be spaced along the panel surface sufficiently far apart to permit easy access. Identification for each of the terminal sections can also be provided on the panel surface.

11 Claims, 4 Drawing Figures

TEST CONNECTOR ADAPTOR

BACKGROUND OF THE INVENTION

1. Field of the Invention

This invention relates generally to electrical connector adaptors; and, more particularly, to connector adaptors for use in connection with the electrical diagnostic system of an automobile.

2. Prior Art

Various automobiles use diagnostic connectors wherein electrical connections coupled to various points in an automobile electrical system are gathered at a central diagnostic connector. That is, at a diagnostic connector there are available a variety of electrical signals from various parts of the automobile such as the engine electrical system and the air-conditioning electrical system. The arrangement of the connectors in the diagnostic connector can be, for example, a plurality of linearly aligned recessed terminals. Special equipment has been developed for easily interconnecting with the diagnostic connector and analyzing the electrical signals available at the diagnostic connector. Although such special equipment permits relatively easy and rapid testing of the automobile electrical system, it is also relatively expensive and typically restricted to the specific use of testing the output of a diagnostic connector. As a result, the usefulness of the diagnostic connector is severely limited to those in the automobile service industry who cannot afford or are reluctant to purchase such an expensive piece of specialized test equipment.

Nevertheless, since the electrical signals are available at the diagnostic connector and instruction manuals are available for analyzing the electrical signals, service centers not having special equipment are tempted to use the diagnostic connectors with standard test equipment by such means as inserting screwdrivers to obtain electrical connection. This is very undesirable in that it tends to deform or otherwise wear the recessed terminals. Additionally, a user must remember which electrical signals are available at which of the recessed terminals. Since the user may have difficulty remembering the function available at each of the recessed connectors, incorrect diagnostic results may be obtained by connecting to the wrong connector. As a result, there is a desire to be able to use presently available test equipment to take advantage of the diagnostic connectors now available to evaluate automobile electrical system. The cost of providing this should be relatively low and use of the diagnostic system should be relatively easy. Access to the recessed terminals of the diagnostic connector should be readily available and understandable. Thus, there is desired a low cost alternative to a complete test apparatus which couples to the diagostic connector and performs certain electrical tests selected by such devices as selector knobs, push buttons and meters.

SUMMARY OF THE INVENTION

A connector adaptor for electrical interconnection with a diagnostic connector automobile in accordance with an embodiment of this invention improves access to the diagnostic connector and facilitates performing various diagnostic procedures on electrical signals, which are now readily available, from the diagnostic connector. The connector adaptor includes a plurality of elongated conductive members adapted to be individually associated with the electrical terminals of the diagnostic connector. Each of the conductive members includes an integral first terminal section and an integral second terminal section. The first terminal section is receivable by the electrical terminals of the diagnostic connector. The second terminal sections are spaced from one another on a surface so that the spacing between each of the second terminals is greater than the smallest spacing between adjacent first terminal sections thus improving acess to the diagnostic connector. An embodiment of this invention can also include labeling means visually associated with the second terminal sections for identifying each of the second terminals sections.

An embodiment of this invention can provide an access and labeling system for a diagnostic connector whereby standard test equipment can be used in conjunction with the diagnostic connector to evaluate the electrical signals available at the diagnostic connector. For example, the terminals of the connector adaptor for coupling to the test equipment can be spaced from each other along a plane which includes visual identification associated with each of the terminals indicative of the particular electrical terminal of the diagnostic connector to which the terminal of the connector adaptor is connected. A connector adaptor in accordance with an embodiment of this invention is relatively compact, easy to use, easy to manufacture, relatively inexpensive and permits the use of standard test equipment to obtain acess to the electrical signals at the diagnostic connector.

DETAILED DESCRIPTION OF THE INVENTION

Figure 1:
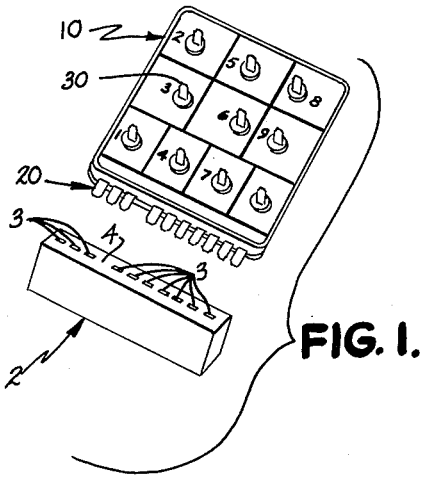
FIG. 1 is an exploded perspective view of a diagnostic connector and a connector adaptor in accordance with an embodiment of this invention.

Referring to FIG. 1, a diagnostic connector 2 has a plurality of recessed terminals 3 positioned in a line and electrically coupled to various parts of an automobile electrical system. For example, one such diagnostic connector 2 can be used to centrally gather electrical connections to various portions of an engine electrical system such as the battery, the starter and the ignition. Another such diagnostic connector 2 can be coupled to centrally gather electrical connections to various portions of an air-conditioning electrical system such as the blower motor and the thermostatic switch. There is a space 4 between the third and fourth terminals 3 from one end to prevent diagnostic testers from being plugged into connector 2 improperly.

A connector adaptor 10 has generally parallel elongated conductive strips 20 through 29 which extend beyond the edge of a generally flat encasement 14 (FIG. 2) and are laterally spaced from one another so one conductive strip connects to each of recessed terminals 3. Each of conductive strips 20 through 29 is generally L-shaped (FIG. 4), made from flat stock, includes a leg section 40 through 49, respectively, and an integral, perpendicular terminal section 30 through 39, respectively. Terminal sections 30 through 39 (FIG. 2) extend from a bend in each of conductive strips 20 through 29, respectively, through encasement 14 and beyond the top major surface of encasement 14. The distance each of terminal sections 30 through 39 extends beyond encasement 14 is substantially the same and is large enough to readily provide a surface for the connection of an electrical test equipment piece. One end of each of leg sections 40 through 49 is integrally connected to the end of terminal sections 30 through 39, respectively, within encasement 14 and the other end of leg sections 40 through 49 extends beyond an edge of encasement 14 a distance sufficient to make contact with recessed terminals 3 (FIGS. 2 and 3) thereby acting as another terminal. Advantageously, for ease of connection, the ends of conductive strips 20 through 29 have flats across the corners thereby tapering the ends to ease passage into a recessed terminal 3.

Figure 2:
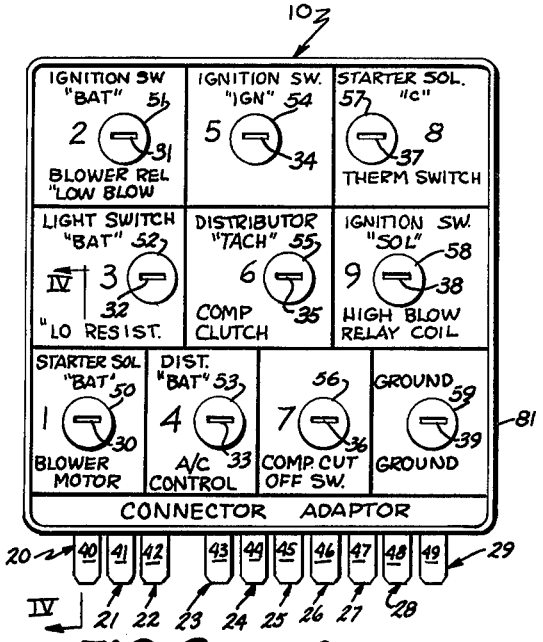
FIG. 2 is a top plan view of a connector adaptor in accordance with an embodiment of this invention with typical labeling of the functions of the electrical signals available at the terminals of the connector adaptor.
Figure 3:
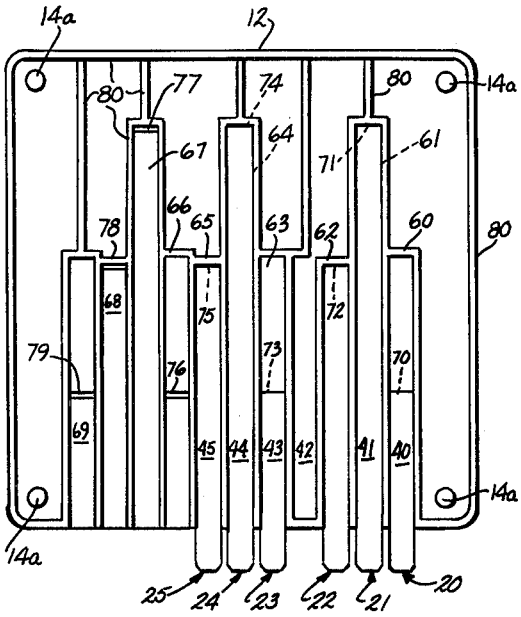
FIG. 3 is a back plan view of the front plate of a connector adaptor shown in FIG. 2 with some electrical connector members in place and some removed.

The length of each of leg sections 40 through 49 varies according to the distance of the associated terminal section 30 through 39 from the edge of encasement 14. Referring to FIGS. 2 and 3, leg sections 40 43, 46 and 49 have an equal short length; leg sections 42, 45 and 48 have an equal intermediate length; and leg sections 41, 44 and 47 have an equal long length. The side by side spacing of conductive strips 20 through 29 is equal except for the spacing between conductive strip 22 and 23 which is equal to the width of space 4 of diagnostic connector 2. Thus, connector adaptor 10 can only be inserted in one way and into diagnostic connector 2. A typical width for each conductive strip is about ¼ of an inch, a typical thickness is about 1/32 of an inch, a typical short leg length is 1½ inches, a typical intermediate leg length is 3 inches, a typical long leg length is 4¼ inches, and a typical material is a soft brass.

Encasement 14 supports and rigidifies conductive strips 20 through 29, protects the portions of conductive strips 20 through 29 within encasement 14, and is resistant to oil and gas and other substances which may deteriorate or affect the performance of connector adaptor 10. Encasement 14 includes a generally planar and rectangular front plate 12 and a similarly sized, rectangular planar back plate 13. Referring to FIG. 3, the inside face of front plate 12 has four alignment posts 14*a*, one positioned at each corner, protruding from front plate 12 to enter four similarly spaced recesses (not shown) in back plate 13. The inside surface of front plate 12 also includes a plurality of raised ridges 80 which define the lateral boundaries of slots 60 through 69 which are associated with leg sections 40 through 49, respectively. Ridges 80 are raised lines or walls extending outwardly from the inside surface of front plate 12 to a height at least equal to the thickness of the conductive strips. Slots 60 through 69 serve to align as well as electrically insulate leg sections 40 through 49 from each other. Each slot 60 through 69 has an associated aperture 70 through 79, respectively, which extends transversely across the slot at the position where the associated leg section (40–49) joins the appropriate terminal section (30–39) thereby providing a passageway for each terminal section to extend through front plate 12 (FIG. 3). Slots 61, 62, 64, 65, 67 and 68 extend from the edge of front plate 12 to apertures 71, 72, 74, 75, 77 and 78, respectively. Slots 60, 63, 66, and 69 extend beyond associated apertures 70, 73, 76 and 79, respectively, but need not necessarily do so. Ridge 80 extends around the entire periphery of front plate 12 except where conductive strips 20 through 29 extend across the edge of front plate 12.

Figure 4:
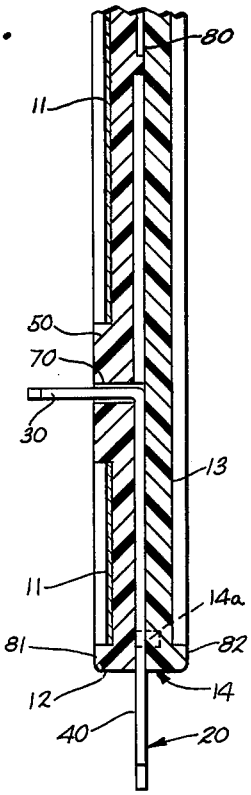
FIG. 4 is a sectional view taken generally along line IV—IV of FIG. 2.

The outside face of plate 12 appears recessed because of a peripheral edge 81 and raised dimples 50 through 59 associated with apertures 70 through 79, respectively. Dimples 50 through 59 are short, generally cylindrical, extend outwardly from the outside face of front plate 12 and are each centered about an aperture. Referring to FIG. 4, a cross-sectional view of front plate 12 shows the height of edge 81 and the height of dimple 50 to be equal. The outside face of back plate 13 has a peripheral edge 82 similar to edge 81 and is otherwise generally planar. A printed back sheet (not shown) can be attached to the outside face of back plate 13 within edge 81, which helps to protect the printed sheet from wear and abrasion. The printed sheet can conveniently present such information as circuit diagrams of the engine and air-conditioning electrical systems. Back plate 13 is a generally planar inside surface but with the aforementioned recesses for receiving posts 14*a*.

The recessed portion of the outside face of front plate 12 is covered by a label sheet 11 which is a generally planar surface with printing on it backed by a pressure sensitive adhesive. Referring to FIG. 2, the lettering on a typical label sheet 11 is shown. Label sheet 11 is divided visually into rectangles which each include one terminal section. The lettering of the top portion of each rectangle indicates the function of the electrical signal information carried by the terminal section when connector adaptor 10 is connected to a diagnostic connector 2 for an engine electrical system and the writing at the bottom of the rectangle indicates the function when connector adaptor 10 is connected to a diagnostic connector 2 for an air-conditioning electrical system. The electrical and air-conditioning system legends, conveniently, are different colors to minimize chances ffor errors. Terminal section 30 is within a rectangle designated 1 and has the function of either starter solenoid battery or blower motor; terminal section 31 is within a box labeled 2 and has the function of either ignition switch battery input or blower relay-low blower; terminal section 32 is within a box labeled 3 and has the function of either light switch battery input or low blower resistor; terminal section 33 is within a box labeled 4 and has the function of either distributor battery input or AC on/off control; terminal section 34 is within a box labeled 5 and has the function ignition switch output; terminal section 35 is within a box labeled 6 and has the function of distributor tachometer output or compresser clutch input; terminal section 36 is within a box labeled 7 and has the function compressor cut off switch input; terminal section 37 is within a box labeled 8 and has the function of either starter solenoid input or thermostatic switch input; terminal section 38 is within a box labeled 9 and has the function of either ignition switch output to solenoid or high-blower relay coil input; and terminal section 39 is within a box labeled ground. Thus, connector adaptor 10 provides ready access to and labeling of the recessed terminals 3 of the diagnostic connector for either the electrical system or the air-conditioning system.

In fabricating connector adaptor 10, front plate 12 and back plate 13 are injection molded of an insulating material such as ABS plastic. Conductive strips 20 through 29 are formed and bent so leg sections 40 through 49 and terminal sections 30 through 39 have the desired lengths. Terminal sections 30 through 39 are positioned through apertures 70 through 79, respectively, and leg sections 40 through 49 are positioned in slots 60 through 69, respectively. After conductive strips 20 through 29 are in place, front plate 12 and back plate 13 can be joined by a variety of methods including sonic welding. If desired, encasement 14 can be molded as one piece with conductive strips 20 through 29 in place. However, such molding can slow cycle time and thereby increase cost.

Label sheet 11 is typically first printed and then applied to front plate 12 after front plate 12 has been joined to back plate 13 with conductive strips 20 through 29 in place.

Various modifications and variations will no doubt occur to those skilled in the art to which this invention pertains. For example, the particular relative arrangement of the terminal sections can be varied from that disclosed herein. Further, the means of identifying each of the terminal sections may be varied from that disclosed herein. These and all other variations which basically rely on the teachings through which this disclosure has advanced the art are properly considered within the spirit and broader aspects of this invention.

The embodiments of this invention to which an exclusive property or privilege is claimed are defined as follows:

1. A connector adaptor for electrical interconnection with a diagnostic connector in an automobile, the diagnostic connector including a plurality of linearly aligned individual electrical connectors, said adaptor including:

a plurality of elongated conductive members adapted to be individually associated with said electrical connectors, each of said conductive members including an integral first terminal section and an integral second terminal section, said first terminal sections being receivable by said electrical connectors and being colinearly aligned with said electrical connectors when connected to said electrical connectors, each of said second terminal sections being spaced from one another along a surface so that the spacing between each of said second terminal sections along each of two perpendicular axes is greater than the smallest spacing between adjacent first terminal sections thereby inproving electrical access to the diagnostic connector; and an encasement means for insulatively supporting and rigidifying said conductive members.

2. A connector adaptor as recited in claim 1 further comprising a labeling means for identifying each of said second terminal sections, said labeling means including identification visually associated with each of said second terminal sections.

3. A connector adaptor as recited in claim 2 wherein said conductive members are generally L-shaped, elongated and fabricated of a flat stock, said first and second terminal sections being at the extremities of said conductive members and having longitudinal axes generally perpendicular to one another, and said first terminal section being part of a leg section extending from said second terminal section of each of said conductive members, at least some of said leg sections being of differing lengths.

4. A connector adaptor as recited in claim 3 wherein said encasement means includes electrically isolated internal passages for said leg sections, each of said internal passages having a first aperture and a second aperture connecting said internal passage to the exterior through said encasement means, said first aperture adapted for passing said first terminal section and said second aperture adapted for passing said second terminal section.

5. A connector adaptor as recited in claim 4 wherein:

said encasement means is generally flat with two major substantially planar exterior surfaces, said encasement means having at least one edge along which said first terminal sections are positioned at spaced positions so the flat surfaces of said first terminal sections are generally parallel to said exterior surfaces of said encasement means;

said first terminal sections extend beyond said encasement means substantially the same distance;

said legs sections of adjacent conductive members are parallel and of differing lengths; and said second terminal sections extend above the same major exterior surface of said encasement means substantially the same distance.

6. A connector adaptor as recited in claim 4 wherein:

said leg sections have one of three different lengths, the longest of said leg sections being positioned adjacent the shortest of said leg sections and the intermediate length leg section being positioned between the longest and the shortest leg sections.

7. A connector adaptor as recited in claim 5 wherein said encasement means includes two generally flat rectangular plates positioned on opposite sides of said leg sections and at least one of said plates having slots for passing said leg sections and at least partially defining said internal passageways.

8. A connector adaptor as recited in claim 7 wherein:

ten second terminal sections are arranged in three linearly aligned groups, two of the groups having three second terminal sections and one group having four terminal sections;

the spacing between all but two adjacent first terminal sections is equal; and said labeling means is visually divided into at least ten sections, each section including at most one of said second terminal sections and identification of the included second terminal section, and said labeling means being coupled to said encasement means.

9. A connector adaptor as recited in claim 2 wherein:

said labeling means includes a printed surface coated on one side with a pressure sensitive adhesive;

said encasement means is molded of an ABS plastic; and said conductive members are made of brass and have a width of about one-fourth inch.

10. A connector adaptor for electrical interconnection with a diagnostic connector in an automobile, said adaptor comprising:

a series of generally L-shaped, conductive strips formed from generally flat stock, each such strip having a leg section and a terminal section generally perpendicular thereto, the leg sections of at least some of said strips being of differing lengths; and an insulative encasement for said strips, said encasement encasing and rigidifying said strips with the leg sections thereof generally parallel to and relatively closely spaced from one another, the terminal sections extending outwardly through said encasement and protruding from the face thereof whereby electrical connection may be made thereto and the extremities of the legs sections protruding from one side of said encasement an approximate equal distance for conductive engagement with said connector, adjacent strips having leg sections of differing lengths to space said protruding terminal sections from one another on the face of said encasement.

11. A connector adaptor as recited in claim 10 wherein the face of said encasement is visually divided into sections, each such section having one of said terminal sections protruding therefrom and further including legends within each of said sections indicative of the particular diagnostic contact on said diagnostic connector to which the terminal section is connected.

* * * * *